United States Patent [19]

Wiest

[11] Patent Number: 4,951,581

[45] Date of Patent: Aug. 28, 1990

[54] COMBINED OIL GUN AND COAL GUIDE FOR POWER PLANT BOILERS

[75] Inventor: Michael R. Wiest, Coatesville, Pa.

[73] Assignee: Aptec, Inc., Honey Brook, Pa.

[21] Appl. No.: 369,336

[22] Filed: Jun. 21, 1989

[51] Int. Cl.[5] ..... F23C 1/10; F23C 1/12

[52] U.S. Cl. ..... 110/262; 110/260; 110/263; 431/189; 431/284

[58] Field of Search ..... 110/261, 262, 260, 263, 110/264; 431/284, 285, 189

[56] References Cited

U.S. PATENT DOCUMENTS 3,256,842 6/1966 Vigneron et al. ..... 110/261 X
4,836,772 6/1989 LaRue ..... 110/263 X

FOREIGN PATENT DOCUMENTS 698697 11/1930 France ..... 110/260

*Primary Examiner*—Edward G. Favors
*Attorney, Agent, or Firm*—Howson and Howson

[57] ABSTRACT

In a power plant boiler having oil and coal burning capability, a coal disperser support tube and an oil gun extending through the disperser support tube are slidable in a bearing sleeve extending through a removable access plate in the wall of an elbow of a coal guide. The disperser is arranged to be withdrawn into the coal guide delivery pipe by a first two-position, reversible, linear pneumatic actuator, and the oil gun is arranged to be withdrawn into the disperser support tube by a second similar actuator the body of which is carried with the piston of the first actuator and the piston of which is connected to the oil gun. The piston of the second actuator is withdrawn when the piston of the first actuator is extended to minimize space requirements. The dispenser support, oil gun, actuators, and associated parts are all mounted on the removable access plate, and can be removed as a unit with the access plate. Air is pumped into a space between axially spaced bearings in the bearings sleeve to cause high velocity flow of air past the bearing nearest the discharge end of the coal guide to prevent coal particles from approaching the bearings. Nuts on threaded studs extending axially from a flange on an outer sheath, secured to the coal guide and surrounding the bearing sleeve, provide angular adjustment of the bearing sleeve assembly for precise centering of the disperser support in the coal guide.

8 Claims, 7 Drawing Sheets

COMBINED OIL GUN AND COAL GUIDE FOR POWER PLANT BOILERS

Brief Summary of the Invention

In large-scale, coal-fired steam turbine power plants used for electric power generation, it is desirable to provide a capability of burning alternative fuels. In most existing coal-fired power plants, provisions are made for burning natural gas or fuel oil as well as pulverized coal to fire the same boiler. The principal reason for this is that it is extremely difficult to ignite pulverized coal in a cold furnace. Thus, in a typical installation, provisions are made to introduce fuel oil through an array of oil guns to start a fire ball, and to replace the oil with pulverized coal as a fuel after the fire ball is established.

In some power plants, it is also desirable to provide for the introduction of oil as an auxiliary fuel when, because of low load conditions, the rate of coal introduction is insufficient to maintain a stable fire ball.

In furnaces designed to burn coal and fuel oil, the oil is introduced through a device known as an "oil gun" consisting of an elongated tube having a nozzle at one end designed to spray the oil into the combustion chamber. Prolonged exposure of the oil nozzle to the heat of the coal-fired flame rapidly damages the nozzle. Therefore, conventional practice has been to withdraw the oil gun manually, after the fire ball has been established, so that its nozzle is no longer exposed to radiant heat from the coal-fired flame.

Pulverized coal is introduced, along with primary air, through a device known as a "coal delivery pipe". A disperser, also known as an "impeller" is provided at the outlet opening of the coal delivery pipe. The disperser typically consists of a series of coaxial, frusto-conical members designed to distribute the coal stream in the desired pattern in the combustion chamber.

A typical large-scale power plant furnace may have as many as nine or more coal delivery pipes, and a similar number of oil guns. It is frequently the case that not all of the coal delivery pipes are in use. When a coal delivery pipe is out of service, it is desirable to withdraw its disperser in order to minimize damage to the disperser and thereby prolong its useful life.

In the past, oil guns have been located within tubular disperser supports along the axes of the coal delivery pipes, and provisions have been made for power-assisted positioning of dispersers and for manual extension and withdrawal of the oil guns. Up to the present time, however, no one has discovered a practical way to effect power-assisted extension and withdrawal of an oil gun and disperser in a burner in which the oil gun and disperser are coaxial.

An important object of this invention is to provide a simple and practical way to effect selective, power-assisted extension and withdrawal of a coaxial oil gun and coal disperser in a coal and oil-fired power plant boiler.

Another object of the invention is to provide for selective, power-assisted extension and withdrawal of a coaxial oil gun and coal disperser while utilizing a minimum of space.

Still another object of the invention is to provide an apparatus for selective, power-assisted extension and withdrawal of a coaxial oil gun and coal disperser which can be easily removed for repair and replacement.

Still another object of the invention is to provide an apparatus for selective, power-assisted extension and withdrawal of a coaxial gun and coal disperser, in which damage to parts due to movement of pulverized coal through the coal guide is minimized.

Still another object of the invention is to provide a simple and easily adjusted means for precise centering of the coal disperser and disperser support with respect to the axis of the coal delivery pipe.

The apparatus of the invention includes a coal guide comprising a delivery pipe for introducing pulverized coal into the combustion chamber. The delivery pipe has an axis, a coal delivery opening at one end, and an elbow at the other end for receiving pulverized coal moving in a direction transverse to the axis of the delivery pipe and guiding the received coal into the delivery pipe for movement along the axis. The apparatus also includes a coal disperser with a tubular disperser support extending along the axis of the delivery pipe and through the wall of the elbow. The support holds the coal disperser adjacent to the coal delivery opening of the delivery pipe. The apparatus also includes an oil gun comprising an oil tube having an oil delivery nozzle at one end. The oil tube is longer than the tubular disperser support and slidable therein. A first actuator is connected to the tubular disperser support outside said elbow means, for moving the disperser support along the axis of the delivery pipe to position the disperser alternatively at a location within the delivery pipe or within the combustion chamber at a location beyond said one end of the delivery pipe. A second actuator, connected to the oil tube outside the elbow moves the oil delivery nozzle relative to the tubular disperser support so that the nozzle can extend into the combustion chamber beyond the end of the tubular disperser support, and can be retracted into the interior of the tubular disperser support.

In the preferred embodiment of the invention, the actuators are arranged so that the body of the first actuator is connected to the coal guide, the piston of the first actuator is connected to the body of the second actuator, and the piston of the second actuator is connected to the oil gun. This arrangement allows the oil nozzle to be extended from the disperser support tube not only when the disperser is extended into the combustion chamber but also when the disperser is retracted, and minimizes the space required behind the coal guide for actuators and associated equipment.

Preferably, the coal guide has a removable access plate in the wall of its elbow means at the outside of the bend. The access plate has a sleeve extending through it and aligned with the axis of the coal delivery pipe. The tubular disperser support and oil tube extend through the sleeve, and the tubular disperser support, the oil tube, and the first and second actuators are supported on the removable access plate and removable therewith as a unit.

Preferably, the sleeve has a pair of axially spaced bearings surrounding the tubular disperser support, an air space within the sleeve between the bearings, and an opening for introducing air into the air space in order to cause air to flow, between the tubular disperser support and the bearing nearest the delivery end of the coal delivery pipe, into the coal guide to keep pulverized coal away from the bearings.

A set of studs is secured to said coal guide and extends substantially parallel to the axis of the coal delivery pipe. The studs are arranged in a pattern surrounding the tubular disperser support. A flange secured to the sleeve extending through the access plate has a pattern of holes receiving the studs. Nuts on the studs adjust the relationship of the flange to the coal guide, so that the angle of the axis of the sleeve relative to the axis of the delivery pipe of the coal guide can be adjusted to achieve precise centering of the disperser support in the delivery pipe.

Other objects and advantages of the invention will become apparent from the following detailed description.

Detailed Description

Figure 1:
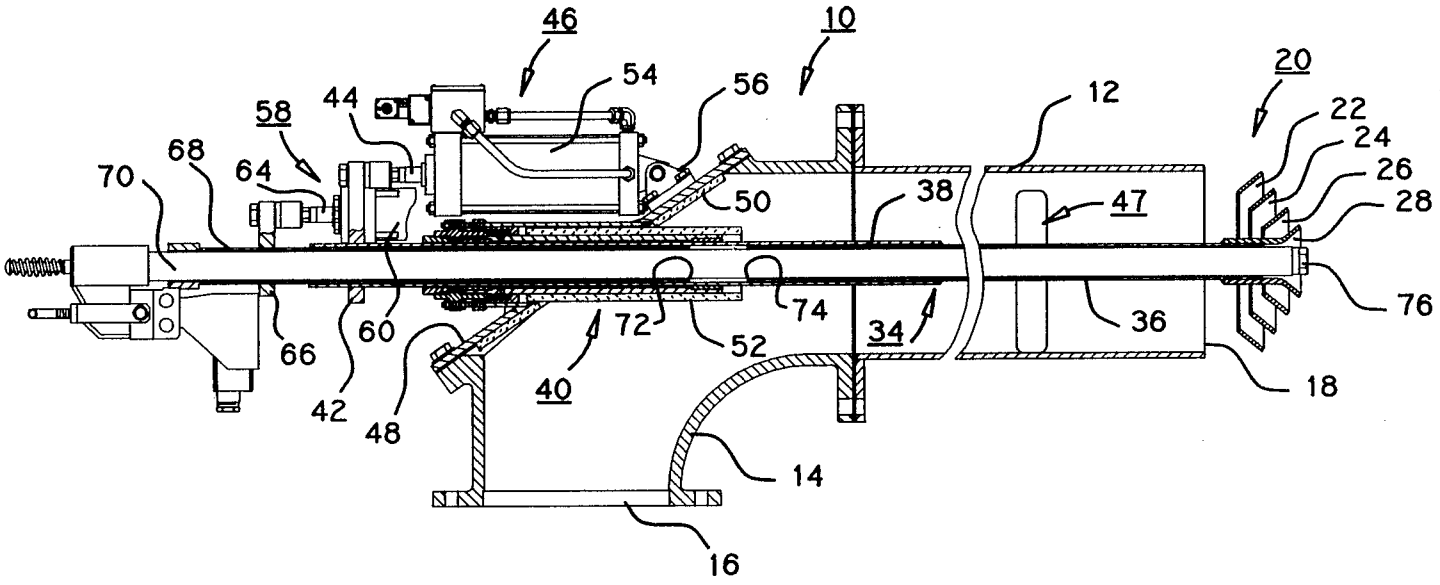
FIG. 1 is an axial section of the preferred fuel introduction apparatus of the invention, showing the actuator assembly and showing the coal disperser and oil gun both extended.

Referring to FIG. 1, the coal guide 10 comprises a delivery pipe 12 connected by means of flanges to a right angle elbow 14. The coal guide receives pulverized coal together with primary air through opening 16 and delivers the coal-air mixture through opening 18 into the combustion chamber of a boiler.

Figure 5:
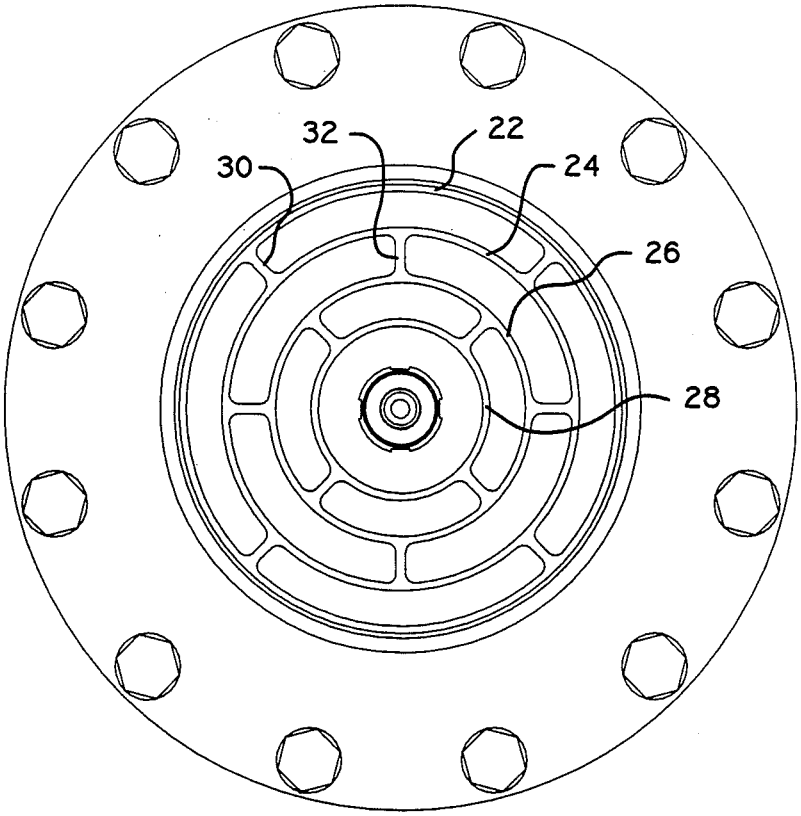
FIG. 5 is an elevational view showing the disperser, as seen from the right side of FIG. 1.

The pulverized coal entering the combustion chamber is distributed by a disperser or "impeller" 20, which is a unitary casting formed to provide a set of coaxial, frusto-conical members 22, 24, 26 and 28, held together by webs such as webs 30 and 32 as shown in FIG. 5. The disperser is mounted at the end of an elongated tubular disperser support 34, which comprises a first tube 36 and a second tube 38 secured to tube 36. Tube 38 extends through a bearing sleeve assembly 40 to the exterior of the coal guide, where it is coupled by clamp 42 to the piston rod 44 of a reversible, two-position, linear pneumatic actuator 46.

A centering tripod is provided at 47, comprising three elements welded to tube 36 and extending radially, 120 degrees apart, toward the inner wall of the coal delivery pipe 12. This tripod helps support the weight of the disperser, especially when the disperser is in the extended condition. It also insures that the disperser cannot move far from its centered condition with respect to the coal delivery pipe. Provisions adjusting the alignment of the disperser and its supporting tube with the coal delivery pipe are described below with reference to FIG. 4.

Sleeve assembly 40 extends through a removable access plate 48 which is located at the outside of the bend of elbow 14. The access plate has a wear-resistant ceramic tile lining 50, and the sleeve assembly 40 is surrounded by a wear-resistant ceramic tube 52. The ceramic lining and tube prevent damage to the access plate and sleeve assembly by abrasion resulting from the movement of pulverized coal at high velocity through the elbow bend in the coal guide.

The body 54 of actuator 46 is secured to the access plate by a clevis 56, so that actuator body 54 is fixed against axial movement relative to the coal delivery pipe.

A second reversible, two-position, linear pneumatic actuator 58 has its body 60 secured to the piston 44 of actuator 46 by means of a connecting plate 62 (FIG. 2) so that the body of actuator 58 travels with piston 44. The piston 64 of actuator 58 is connected by means of a clamp 66 to a tube 68, which surrounds and is secured to an oil gun 70. Tube 68 extends slidably into tube 38 of the disperser support and terminates at end 72, which, as seen in FIG. 1, is spaced axially from end 74 of tube 36 of the disperser support.

Oil gun 70 is longer than the disperser support, and extends through the disperser support, terminating in a nozzle 76 which, as shown in FIG. 1, extends beyond the disperser.

Figure 2:
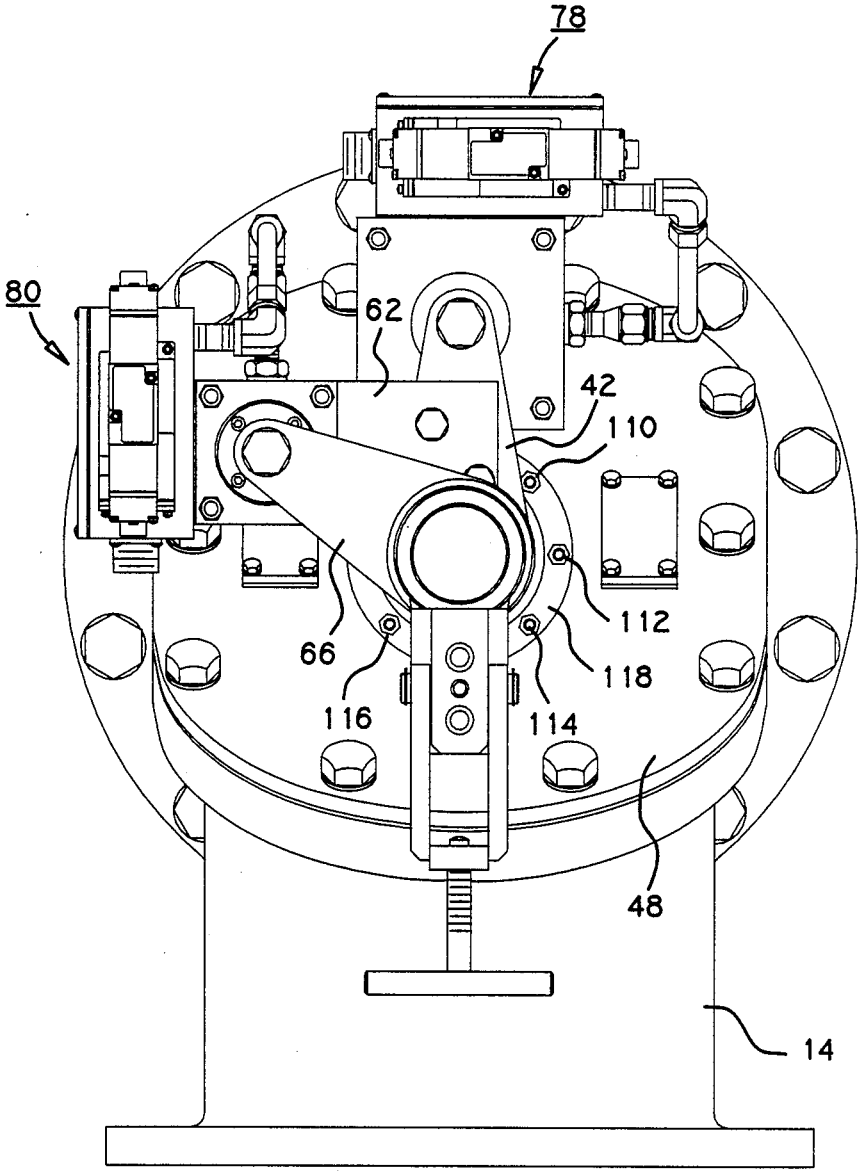
FIG. 2 is an elevational view of the apparatus, as seen from the left side of FIG. 1.
Figure 3:
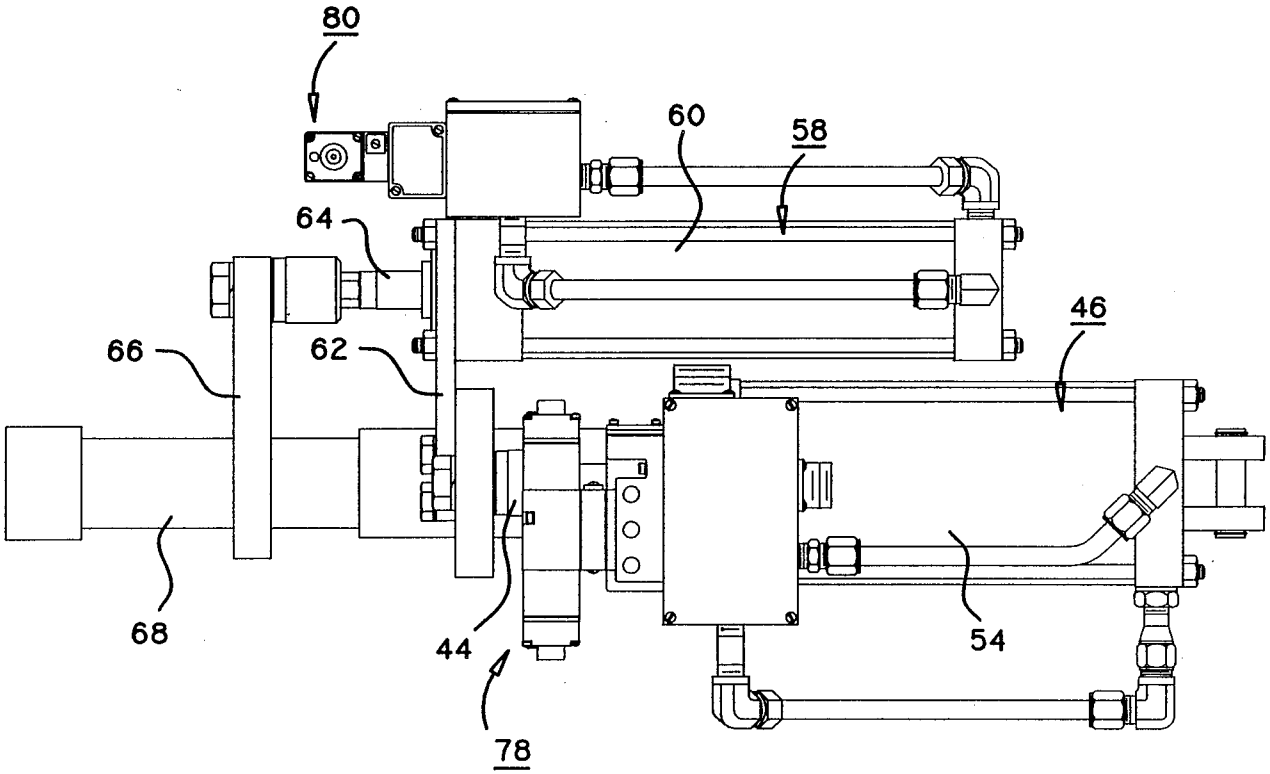
FIG. 3 is a top plan view of the actuator assembly of FIG. 1.

Control of the actuators is achieved through electrically activated solenoid valves 78 and 80, seen in FIGS. 2 and 3.

Figure 4:
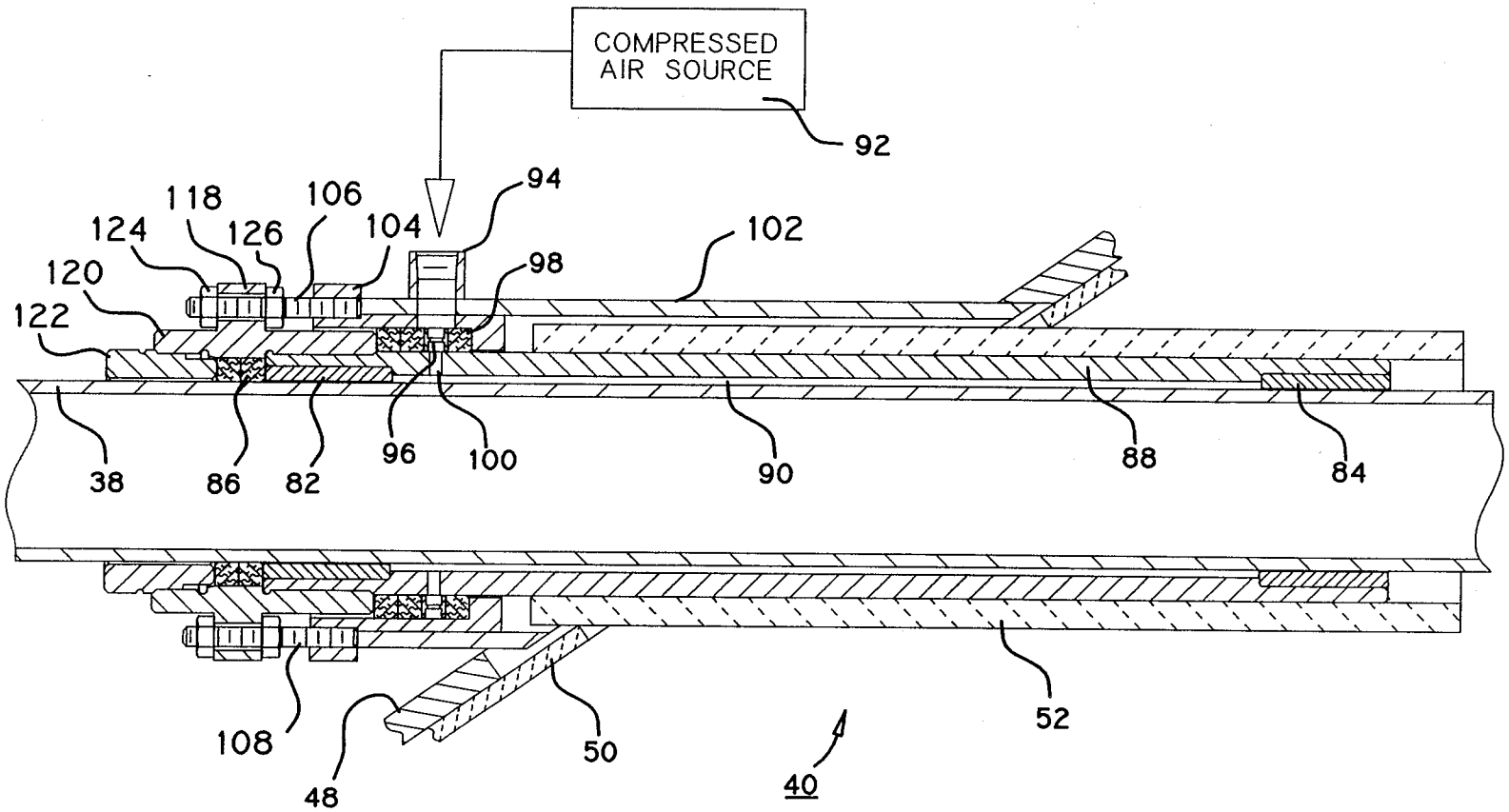
FIG. 4 is a fragmentary section showing details of the sleeve extending through the removable access plate, the port through which air is introduced into the space within the sleeve between the bearings for the tubular disperser support, and the nuts and studs for adjusting the sleeve angle.

Referring now to FIG. 4, which illustrates some of the details of the sleeve assembly, tube 38 of the disperser support is slidable in a pair of similar graphite bearings, one of which is shown at 82 and the other of which is shown at 84. Graphite packing 86 is provided to the left of bearing 82, but no similar graphite packing is provided to the right of bearing 84. The two bearings are supported in a sleeve 88 and are axially spaced from each other to provide an air space 90 between tube 38 and sleeve 88. Air from a compressed air source 92, which can be the same source operating the actuators, is introduced into space 90 through connection 94, a lantern ring 96, held by graphite packings 98, and a series of circumferentially spaced radial openings 100 in sleeve 88.

While pulverized coal is being carried through the coal guide, air forced into space 90 by the compressed air source escapes at high velocity through the small clearance between bearing 84 and tube 38. This flow of air past bearing 84 prevents coal particles from approaching the bearing and interfering with its smooth operation.

Precise alignment of the disperser and its supporting tube with the centerline of the coal delivery pipe is desirable in order to take into account tolerances, misalignment and warpage in the coal guide, the disperser support, and the retraction mechanism. Alignment is accomplished by adjustment of the angle of sleeve assembly 40 relative to the coal guide. The outer sheath 102 of the bearing assembly 104, which extends to the left of access plate 48, terminates in a flange 104. Eight threaded studs are set in this flange, two of which are shown at 106 and 108 in FIG. 4, and four more of which are shown at 110, 112, 114 and 116 in FIG. 2. These studs are situated at forty-five degree intervals around flange 104, and extend through holes in a flange 118 of a packing gland 120. The packing gland is engaged with bearing sleeve 88 and a gland nut is provided at 122. Nuts are threaded onto each stud on both sides of flange 118, stud 106, for example having nuts 124 and 126.

By selective loosening and tightening of the sixteen nuts on the studs, the angle of the bearing sleeve assembly can be adjusted for precise centering of the tubular disperser support in the coal guide.

Figure 6:
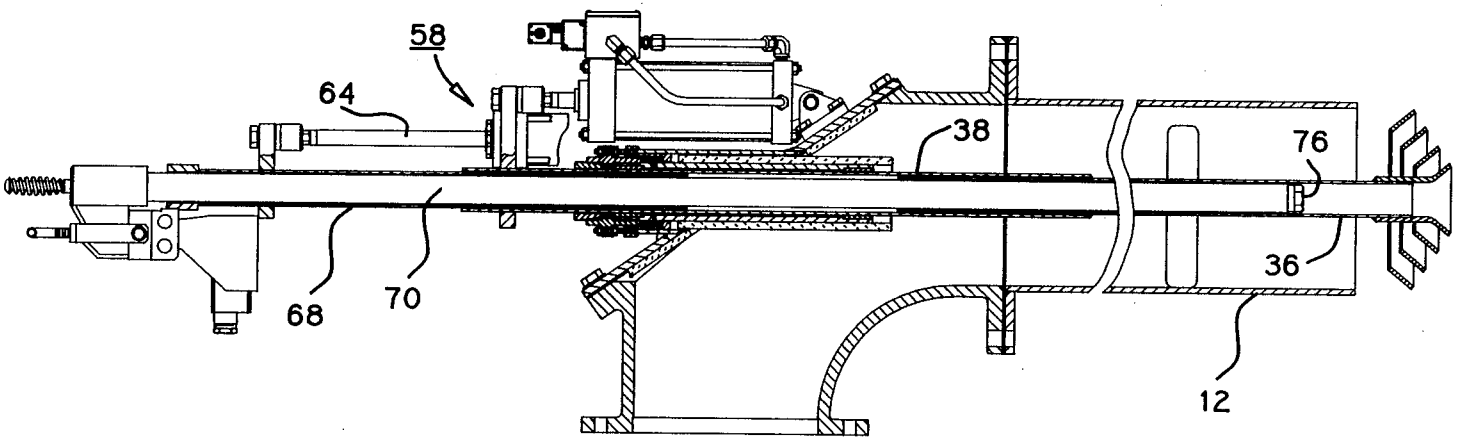
FIG. 6 is an axial section of the apparatus showing the coal disperser extended and the oil gun retracted.
Figure 7:
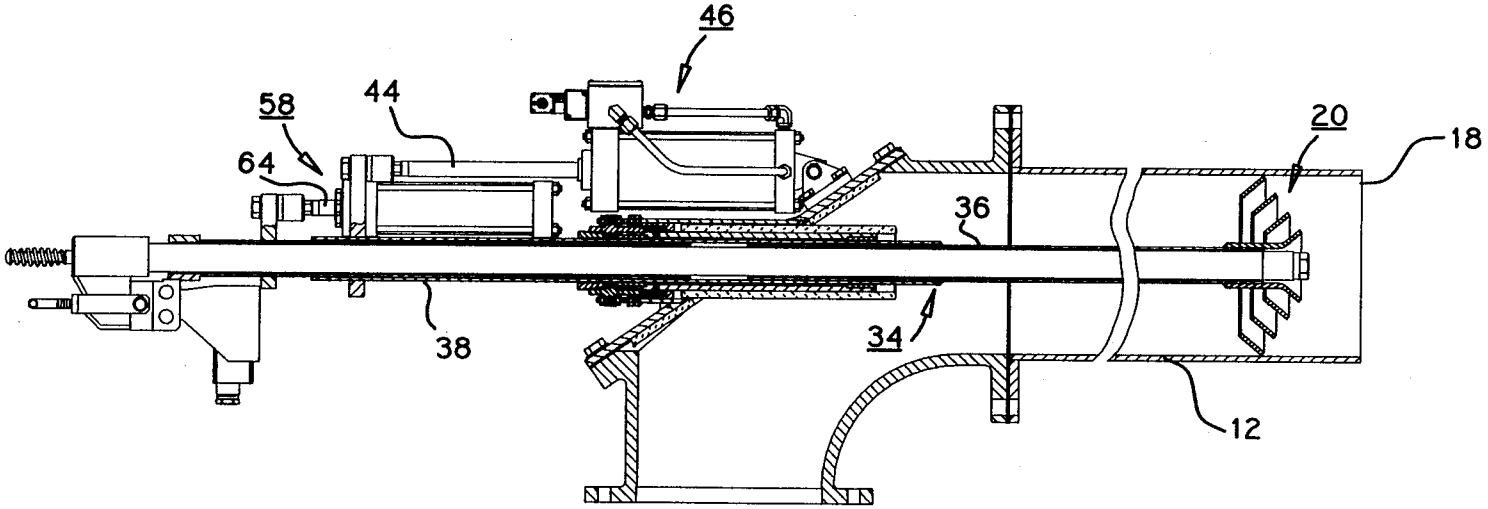
FIG. 7 is an axial section of the apparatus showing the coal disperser and oil gun both retracted.

Operation of the retraction mechanism can best be understood by reference to FIGS. 1, 6 and 7.

FIG. 1 shows the oil gun 70 extended so that its nozzle 76 projects beyond the end of the tubular disperser support 34 into the combustion chamber of the boiler. When the apparatus is in the condition illustrated in FIG. 1, oil can be introduced through the oil gun at start-up. Coal can then be introduced through the coal guide 10 after the fire ball is established, whereupon the oil supply can be shut off. The configuration of FIG. 1 can also be used where continued simultaneous introduction of coal and oil is desired, such as under low load conditions in which, because of the relatively low rate of coal introduction, oil is needed as an auxiliary fuel to maintain a stable fire ball.

When introduction of oil is no longer necessary, the oil nozzle 76 can be withdrawn into tube 36 of the disperser support by causing the piston 64 of actuator 58 to extend. Extension of the actuator piston 64 causes tube 68 to slide to the left within tube 38, as shown in FIG. 6. Oil gun 70, being fixed to tube 68, also moves to the left so that its nozzle 76 is withdrawn to a protected position within tube 36, where it is exposed only to a relatively small amount of radiant heat from the fire ball inside the combustion chamber.

When it is desired to take the burner out of service altogether, the disperser may be withdrawn into the coal delivery pipe 12, as shown in FIG. 7, by causing the piston 44 of actuator 46 to extend. This causes the tubular disperser support 34 to move to the left, its tube 38 sliding in bearings 82 and 84 (FIG: 4). Tube 36, being fixed to tube 38, moves together with tube 38 to the left, carrying the disperser through end opening 18 of delivery pipe 12 to a protected position within the delivery pipe. At the same time piston 44 is extended, piston 64 is retracted, so that the left end of the oil gun assembly does not extend too far to the left of the coal guide when the disperser is withdrawn.

The provision of dual two-position actuators connected in series with each other makes it possible to achieve the three oil nozzle positions depicted in FIGS. 1, 6 and 7 with a very simple mechanism, requiring a minimum of space.

The entire actuator, oil gun, bearing, and disperser assembly is secured to the removable access plate. Consequently, it is possible to remove the entire assembly for service by removing the access plate, without disconnecting the parts of the assembly from one another. Furthermore, the manner in which the assembly is secured to the access plate allows the external parts, including the actuators to balance the weight of the disperser, its tubular support, and the nozzle end of the oil gun. Consequently, unbalanced loads on the bearings in the bearing sleeve assembly are substantially reduced.

While a preferred embodiment has been described, the apparatus can be modified in many respects. For example, other forms of actuators, such as spring-returned pneumatic actuators, hydraulic, or electrically driven actuators can be used. Also, while the disperser support is shown as comprising two tubes, and a tube is provided surrounding the proximal portion of the oil gun, it would be possible to use a single tube as the disperser support and to slide the oil gun through the single disperser support tube. Many other modifications, which may occur to those skilled in the art, may be made without departing from the scope of the invention as defined in the following claims.

I claim:

1. Apparatus for introducing fuel into the combustion chamber of a power plant boiler comprising:

a coal guide comprising a delivery pipe for introducing pulverized coal into the combustion chamber, said delivery pipe having an axis and having a coal delivery opening at one end, and elbow means at the other end of the delivery pipe for receiving pulverized coal moving in a direction transverse to the axis of the delivery pipe and guiding the received coal into the delivery pipe for movement along said axis;

a coal disperser;

tubular disperser support means, extending along said axis of the delivery pipe and through the wall of said elbow means, and supporting said coal disperser at one of the ends of said tubular means adjacent to said coal delivery opening of the delivery pipe;

an oil gun comprising an oil tube having an oil delivery nozzle at one end, said oil tube being longer than said tubular disperser support means and slidable therein;

first actuator means, connected to said tubular disperser support means outside said elbow means, for moving said disperser support means along said axis of the delivery pipe to position said disperser alternatively at a location within said delivery pipe or within the combustion chamber at a location beyond said one end of the delivery pipe; and second actuator means, connected to said oil tube outside said elbow means, for moving said oil delivery nozzle relative to said tubular disperser support means, whereby said nozzle can extend into the combustion chamber beyond said one of the ends of said tubular means, and can be retracted into the interior of the tubular disperser support means;

in which said first actuator means comprises first and second relatively movable elements and means for causing said first and second elements to move relative to each other, and said second actuator means comprises third and fourth relatively movable elements and means for causing said third and fourth elements to move relative to each other, and in which said first element is fixed to the coal guide, said second element is fixed to the tubular disperser support means at a location outside said coal guide, said third element is fixed to said second element, and said fourth element is fixed to said oil tube.

2. Apparatus for introducing fuel into the combustion chamber of a power plant boiler comprising:

a coal guide comprising a delivery pipe for introducing pulverized coal into the combustion chamber, said delivery pipe having an axis and having a coal delivery opening at one end, and elbow means at the other end of the delivery pipe for receiving pulverized coal moving in a direction transverse to the axis of the delivery pipe and guiding the received coal into the delivery pipe for movement along said axis;

a coal disperser;

tubular disperser support means, extending along said axis of the delivery pipe and through the wall of said elbow means, and supporting said coal disperser at one of the ends of said tubular means adjacent to said coal delivery opening of the delivery pipe;

an oil gun comprising an oil tube having an oil delivery nozzle at one end, said oil tube being longer than said tubular disperser support means and slidable therein;

first actuator means, connected to said tubular disperser support means outside said elbow means, for moving said disperser support means along said axis of the delivery pipe to position said disperser alternatively at a location within said delivery pipe or within the combustion chamber at a location beyond said one end of the delivery pipe; and second actuator means, connected to said oil tube outside said elbow means, for moving said oil delivery nozzle relative to said tubular disperser support means, whereby said nozzle can extend into the combustion chamber beyond said one of the ends of said tubular means, and can be retracted into the interior of the tubular disperser support means;

said apparatus having a removable access plate in the wall of said elbow means at the outside of the bend thereof, said plate having a sleeve extending therethrough and aligned with the axis of said delivery pipe, said tubular disperser support means and said oil tube extending through said sleeve, and at least the portion of said sleeve within said elbow having a wear-resistant protective ceramic covering.

3. Apparatus for introducing fuel into the combustion chamber of a power plant boiler comprising:

a coal guide comprising a delivery pipe for introducing pulverized coal into the combustion chamber, said delivery pipe having an axis and having a coal delivery opening at one end, and elbow means at the other end of the delivery pipe for receiving pulverized coal moving in a direction transverse to the axis of the delivery pipe and guiding the received coal into the delivery pipe for movement along said axis;

a coal disperser;

tubular disperser support means, extending along said axis of the delivery pipe and through the wall of said elbow means, and supporting said coal disperser at one of the ends of said tubular means adjacent to said coal delivery opening of the delivery pipe;

an oil gun comprising an oil tube having an oil delivery nozzle at one end, said oil tube being longer than said tubular disperser support means and slidable therein;

first actuator means, connected to said tubular disperser support means outside said elbow means, for moving said disperser support means along said axis of the delivery pipe to position said disperser alternatively at a location within said delivery pipe or within the combustion chamber at a location beyond said one end of the delivery pipe; and second actuator means, connected to said oil tube outside said elbow means, for moving said oil delivery nozzle relative to said tubular disperser support means, whereby said nozzle can extend into the combustion chamber beyond said one of the ends of said tubular means, and can be retracted into the interior of the tubular disperser support means;

said apparatus having a removable access plate in the wall of said elbow means at the outside of the bend thereof, said plate having an opening aligned with the axis of said delivery pipe, said tubular disperser support means and said oil tube extending through said opening, and the part of said plate exposed to the interior of said elbow means having a wear-resistant protective ceramic covering.

4. Apparatus for introducing fuel into the combustion chamber of a power plant boiler comprising:

a coal guide comprising a delivery pipe for introducing pulverized coal into the combustion chamber, said delivery pipe having an axis and having a coal delivery opening at one end, and elbow means at the other end of the delivery pipe for receiving pulverized coal moving in a direction transverse to the axis of the delivery pipe and guiding the received coal into the delivery pipe for movement along said axis;

a coal disperser;

tubular disperser support means, extending along said axis of the delivery pipe and through the wall of said elbow means, and supporting said coal disperser at one of the ends of said tubular means adjacent to said coal delivery opening of the delivery pipe;

an oil gun comprising an oil tube having an oil delivery nozzle at one end, said oil tube being longer than said tubular disperser support means and slidable therein;

first actuator means, connected to said tubular disperser support means outside said elbow means, for moving said disperser support means along said axis of the delivery pipe to position said disperser alternatively at a location within said delivery pipe or within the combustion chamber at a location beyond said one end of the delivery pipe; and second actuator means, connected to said oil tube outside said elbow means, for moving said oil delivery nozzle relative to said tubular disperser support means, whereby said nozzle can extend into the combustion chamber beyond said one of the ends of said tubular means, and can be retracted into the interior of the tubular disperser support means;

said apparatus having a sleeve extending through said elbow means and aligned with the axis of said delivery pipe, said tubular disperser support means and said oil tube extending through said sleeve, and said sleeve having a pair of axially spaced bearings surrounding said tubular disperser support means, an air space within said sleeve between said bearings, and means for introducing air into said air space whereby air is caused to flow between one of said bearings and the tubular disperser support means into the coal guide to keep pulverized coal away from the bearings.

5. Apparatus for introducing fuel into the combustion chamber of a power plant boiler comprising;

a coal guide comprising a delivery pipe for introducing pulverized coal into the combustion chamber, said delivery pipe having an axis and having a coal delivery opening at one end, and elbow means at the other end of the delivery pipe for receiving pulverized coal moving in a direction transverse to the axis of the delivery pipe and guiding the received coal into the delivery pipe for movement along said axis;

a coal disperser;

tubular disperser support means, extending along said axis of the delivery pipe and through the wall of said elbow means, and supporting said coal disperser at one of the ends of said tubular means adjacent to said coal delivery opening of the delivery pipe;

an oil gun comprising an oil tube having an oil delivery nozzle at one end, said oil tube being longer than said tubular disperser support means and slidable therein;

first actuator means, connected to said tubular disperser support means outside said elbow means, for moving said disperser support means along said axis of the delivery pipe to position said disperser alternatively at a location within said delivery pipe or within the combustion chamber at a location beyond said one end of the delivery pipe; and second actuator means, connected to said oil tube outside said elbow means, for moving said oil delivery nozzle relative to said tubular disperser support means, whereby said nozzle can extend into the combustion chamber beyond said one of the ends of said tubular means, and can be retracted into the interior of the tubular disperser support means;

in which said coal guide has a removable access plate in the wall of said elbow means at the outside of the bend thereof, said plate having an opening aligned with the axis of said delivery pipe, said tubular disperser support means and said oil tube extending through said opening, and in which said tubular disperser support means, said oil tube, and said first and second actuators are supported on said removable access plate and removable therewith as a unit.

6. Apparatus according to claim 5 in which said first actuator means comprises first and second relatively movable elements and means for causing said first and second elements to move relative to each other, and said second actuator means comprises third and fourth relatively movable elements and means for causing said third and fourth elements to move relative to each other, and in which said first element is fixed to the access plate, said second element is fixed to the tubular disperser support means at a location outside said coal guide, said third element is fixed to said second element, and said fourth element is fixed to said oil tube.

7. Apparatus for introducing fuel into the combustion chamber of a power plant boiler comprising:

a coal guide comprising a delivery pipe for introducing pulverized coal into the combustion chamber, said delivery pipe having an axis and having a coal delivery opening at one end, and elbow means at the other end of the delivery pipe for receiving pulverized coal moving in a direction transverse to the axis of the delivery pipe and guiding the received coal into the delivery pipe for movement along said axis;

a coal disperser;

tubular disperser support means, extending along said axis of the delivery pipe and through the wall of said elbow means, and supporting said coal disperser at one of the ends of said tubular means adjacent to said coal delivery opening of the delivery pipe;

an oil gun comprising an oil tube having an oil delivery nozzle at one end, said oil tube being longer than said tubular disperser support means and slidable therein;

first actuator means, connected to said tubular disperser support means outside said elbow means, for moving said disperser support means along said axis of the delivery pipe to position said disperser alternatively at a location within said delivery pipe or within the combustion chamber at a location beyond said one end of the delivery pipe; and second actuator means, connected to said oil tube outside said elbow means, for moving said oil delivery nozzle relative to said tubular disperser support means, whereby said nozzle can extend into the combustion chamber beyond said one of the ends of said tubular means, and can be retracted into the interior of the tubular disperser support means;

said apparatus having a sleeve extending through said elbow means, said tubular disperser support means and said oil tube extending through said sleeve, and said sleeve having bearing means surrounding said tubular disperser support means, and cooperating means on said coal guide and on said sleeve for adjusting the angle of the axis of said sleeve relative to the axis of the delivery pipe of the coal guide, whereby the disperser support means can be precisely centered in said delivery pipe.

8. Apparatus for introducing fuel into the combustion chamber of a power plant boiler comprising:

a coal guide comprising a delivery pipe for introducing pulverized coal into the combustion chamber, said delivery pipe having an axis and having a coal delivery opening at one end, and elbow means at the other end of the delivery pipe for receiving pulverized coal moving in a direction transverse to the axis of the delivery pipe and guiding the received coal into the delivery pipe for movement along said axis;

a coal disperser;

tubular disperser support means, extending along said axis of the delivery pipe and through the wall of said elbow means, and supporting said coal disperser at one of the ends of said tubular means adjacent to said coal delivery opening of the delivery pipe;

an oil gun comprising an oil tube having an oil delivery nozzle at one end, said oil tube being longer than said tubular disperser support means and slidable therein;

first actuator means, connected to said tubular disperser support means outside said elbow means, for moving said disperser support means along said axis of the delivery pipe to position said disperser alternatively at a location within said delivery pipe or within the combustion chamber at a location beyond said one end of the delivery pipe; and second actuator means, connected to said oil tube outside said elbow means, for moving said oil delivery nozzle relative to said tubular disperser support means, whereby said nozzle can extend into the combustion chamber beyond said one of the ends of said tubular means, and can be retracted into the interior of the tubular disperser support means;

said apparatus having a sleeve extending through said elbow means, said tubular disperser support means and said oil tube extending through said sleeve, and said sleeve having bearing means surrounding said tubular disperser support means, a set of studs secured to said coal guide and extending substantially parallel to the axis of the coal delivery pipe, said studs being arranged in a pattern surrounding said tubular disperser support means, a flange secured to said sleeve having a pattern of holes receiving said studs, and adjusting nuts on said studs for adjusting the relationship of said flange to the coal guide, whereby the angle of the axis of said sleeve relative to the axis of the delivery pipe of the coal guide can be adjusted to achieve precise centering of the disperser support means in said delivery pipe.

* * * * *